US011629530B2

(12) United States Patent
Schroll

(10) Patent No.: US 11,629,530 B2
(45) Date of Patent: Apr. 18, 2023

(54) PULL THROUGH CABLE LOCK

(71) Applicant: The Eastern Company, Naugatuck, CT (US)

(72) Inventor: Matthew Schroll, Glendale Heights, IL (US)

(73) Assignee: The Eastern Company, Naugatuck, CT (US)

( * ) Notice: Subject to any disclaimer, the term of this patent is extended or adjusted under 35 U.S.C. 154(b) by 306 days.

(21) Appl. No.: 17/083,585

(22) Filed: Oct. 29, 2020

(65) Prior Publication Data

US 2021/0131145 A1 May 6, 2021

Related U.S. Application Data

(60) Provisional application No. 62/929,253, filed on Nov. 1, 2019.

(51) Int. Cl.
*E05B 27/00* (2006.01)
*E05B 67/00* (2006.01)
*E05B 65/00* (2006.01)

(52) U.S. Cl.
CPC ..... *E05B 67/003* (2013.01); *E05B 27/00* (2013.01); *E05B 65/00* (2013.01)

(58) Field of Classification Search
CPC ..... E05B 67/003; E05B 27/00; E05B 65/00; Y10T 70/483; Y10T 70/435; Y10T 70/5022

(Continued)

(56) References Cited

U.S. PATENT DOCUMENTS 1,545,902 A * 7/1925 Johnson ..... E05B 69/003 70/53
1,681,409 A * 8/1928 Johnson ..... B62D 43/007 70/49

(Continued)

FOREIGN PATENT DOCUMENTS

CN 1473232 A * 2/2004 ..... A63C 11/006
DE 202005009751 U1 * 10/2005 ..... E05B 71/00
GB 2293196 A * 3/1996 ..... E05B 67/003

OTHER PUBLICATIONS

Bosvision, "Bosvision 4-digit combination padlock with cable of 2 end loops (loop cable lock) for bike, ski, camping, garden, warehouse and factory," product page downloaded from the Internet at https://amzn.to/2P7EQ61 on Oct. 20, 2020, 9 pp.

(Continued)

*Primary Examiner* — Suzanne L Barrett
(74) *Attorney, Agent, or Firm* — Leydig, Voit & Mayer, Ltd.

(57) ABSTRACT

The invention provides a lock body having a keyway and a throughbore parallel to the keyway with the throughbore having two portions separated by a shoulder. A first cable passes through the throughbore, the first cable having a knob at one end and a chevron at a second end. A second cable depends from and is attached to the lock body. The cable body also has a bolt that is biased partially into the first portion of the throughbore. The keyway has a plug that is rotatable with the proper key to retract the bolt from the throughbore. The chevron can pass by the bolt in an axial first direction by urging the chevron and allowing the taper to move the bolt transversely against the bias, but not in a second axial direction. A base accommodates the lock body and cables and is captured by the second cable.

19 Claims, 4 Drawing Sheets

(58) Field of Classification Search
USPC ..... 70/61, 49, 30
See application file for complete search history.

(56) References Cited

U.S. PATENT DOCUMENTS

| | | | | |
|---|---|---|---|---|
| 2,623,378 | A * | 12/1952 | Haver | B65D 77/185 24/30.5 R |
| 3,738,132 | A * | 6/1973 | Nagel | E05B 67/003 70/49 |
| 3,765,196 | A * | 10/1973 | Balicki | E05B 67/003 70/49 |
| 5,937,678 | A | 8/1999 | Kuo | |
| 6,006,555 | A | 12/1999 | Shu-Fen | |
| 6,131,969 | A | 10/2000 | Natkins | |
| 6,212,919 | B1 * | 4/2001 | Gerow | E05B 67/003 70/49 |
| 6,263,711 | B1 * | 7/2001 | Kuo | E05B 67/003 70/49 |
| D457,802 | S | 5/2002 | Meekma et al. | |
| 6,412,315 | B1 | 7/2002 | Cheng et al. | |
| 6,470,718 | B1 | 10/2002 | Yang | |
| D469,332 | S | 1/2003 | Meekma et al. | |
| 6,629,440 | B1 | 10/2003 | Meekma et al. | |
| 6,775,054 | B1 | 8/2004 | Smith et al. | |
| 7,104,093 | B2 | 9/2006 | Ling et al. | |
| 7,293,438 | B2 * | 11/2007 | Benda | F16G 11/106 70/49 |
| 7,661,280 | B1 * | 2/2010 | Weyland | B62H 5/003 70/30 |
| 7,784,313 | B2 | 8/2010 | Wyers | |
| 7,870,764 | B2 | 1/2011 | Burmesch | |
| 8,056,377 | B2 | 11/2011 | Hacker | |
| 8,297,086 | B2 | 10/2012 | Yu et al. | |
| 8,578,743 | B2 | 11/2013 | Yu | |
| 8,607,600 | B2 | 12/2013 | Burmesch et al. | |
| D702,102 | S | 4/2014 | Stevens | |
| 10,352,068 | B2 | 7/2019 | Hollis | |
| 10,668,866 | B2 | 6/2020 | Kuschmeader et al. | |
| 2003/0196462 | A1 * | 10/2003 | Chen | E05B 67/003 70/49 |
| 2005/0092037 | A1 | 5/2005 | Meekma et al. | |
| 2005/0262904 | A1 | 12/2005 | Ling et al. | |
| 2009/0025433 | A1 * | 1/2009 | Evans | E05B 67/003 138/131 |
| 2016/0194905 | A1 * | 7/2016 | Edell | F04B 33/005 70/15 |
| 2019/0383058 | A1 | 12/2019 | Misner | |
| 2021/0131148 | A1 * | 5/2021 | Schroll | E05B 71/00 |

OTHER PUBLICATIONS

Performance Bicycle, "Abus Multiloop Cable Review," YouTube video downloaded from the Internet at https://bit.ly/2ZhH5Do on Oct. 20, 2020, 7 pp. (Jun. 2, 2015).

Lifeventure, "Sliding Cable Lock," YouTube video downloaded from the Internet at https://bit.ly/2NhRPQ1 on Oct. 20, 2020, 6 pp. (Nov. 16, 2013).

Seattle Sports, "Cradle Lock Instructions," product instructions downloaded from the Internet at https://www.seattlesportsco.com/pub/media/productattach/0/5/058424_cradle_lock_instructions_2011.pdf on Oct. 20, 2020, 1 p. (2011).

* cited by examiner

PULL THROUGH CABLE LOCK

CROSS-REFERENCE TO RELATED APPLICATIONS

This application claims the benefit of, and priority to, U.S. Provisional Patent Application No. 62/929,253 (filed Nov. 1, 2019), which is incorporated by reference herein in its entirety.

BACKGROUND OF THE INVENTION

The present invention is directed toward a cable lock for restraining items. The cable lock may have a pair of cables with one attached to a base.

SUMMARY OF THE INVENTION

The invention provides a cable lock comprising an elongate cable with a first end having a knob, and a second end terminating in a chevron, with the chevron having a tapered end and a flat transverse back face, and a lock body having a first end and a second end and having a keyway and a cylindrical throughbore parallel to the keyway, the throughbore extending from the first end to the second end and having a first portion and a second portion separated by a shoulder. The keyway also has a plug that selectively rotates with a proper key. A bolt is transverse to the throughbore and retractably biased into the throughbore first portion and selectively retractable against the bias out of the throughbore first portion by rotation of the plug. In a first state, the cable second end is accommodated in the throughbore second portion and the cable extends through the throughbore first portion and out of the lock body first end, and in in a second state the cable extends through the throughbore second portion, out of the lock body second end, and the cable first end and the cable second end are captured in the first portion of the throughbore between the bolt and the shoulder with the bolt cooperating with the flat transverse back face of the chevron.

In one embodiment, the knob has a tapered first end attached to the cable and a tapered second end opposite the first end, and the bolt is pushed out of the throughbore by axial movement of the knob in the first portion of the throughbore in a first direction or a second direction, and by axial movement of the chevron in the first direction only.

In one embodiment the chevron is released from the throughbore in the second direction by retracting the bolt. The bolt is retracted by rotation the plug in the keyway by a proper key.

The invention also provides a twin cable lock for securing equipment comprising a lock body having a first end and a second end and having a keyway and a cylindrical throughbore extending through the lock body from the first end to the second end with an axis parallel to the keyway, the throughbore having a first portion and a second portion separated by a shoulder. A first elongate cable extends through the throughbore with a first end having a knob, and a second end terminating in a chevron, with the chevron having a tapered end and a flat transverse back face. A second cable has a first end and depends from and is attached to the lock body first end at the second cable first end. The cable body also has a bolt that is retractably biased into the first portion of the throughbore transverse to the throughbore axis. The keyway has a plug that is rotatable with the proper key to retract the bolt from the throughbore against the bias. The chevron can pass by the bolt as the chevron moves axially in the throughbore in a first direction by the chevron tapered end urging the bolt out of the throughbore against the bias, but the chevron cannot pass by the bolt as the chevron moves axially in the throughbore in a second direction without the bolt being retracted by the plug.

In one embodiment the twin cable lock also comprises a base with a pair of apertures and a cradle with a cable passing through each aperture and the cradle accommodating the lock body in a first state, and the base is captured by the second cable while the first cable can pass through its base aperture.

In one embodiment, the first cable can extend from the second portion of the throughbore and back into the first portion of the throughbore where it is locked in place by pushing the chevron past the bolt.

In one condition, the twin cables and lock body are nested in the base and at least partially hidden from view while not restraining equipment to the base. In a second condition, the lock body and cables can be retracted from the base, the first cable extended through a piece of equipment and both ends of the first cable captured in the lock body to lock the piece of equipment to the base.

Further and alternative aspects and features of the disclosed principles will be appreciated from the following detailed description and the accompanying drawings. As will be appreciated, the principles disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

DESCRIPTION OF A PREFERRED EMBODIMENT

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein are made collectively or individually when there may be more than one element of the same type. However, such references are merely exemplary in nature. It may be noted that any reference to elements in the singular may also be construed to relate to the plural and vice versa without limiting the scope of the disclosure to the exact number or type of such elements unless set forth explicitly in the appended claims. The terms configured and configuration may be used herein to refer to a specified arrangement, or a structural size and shape.

Figure 1:
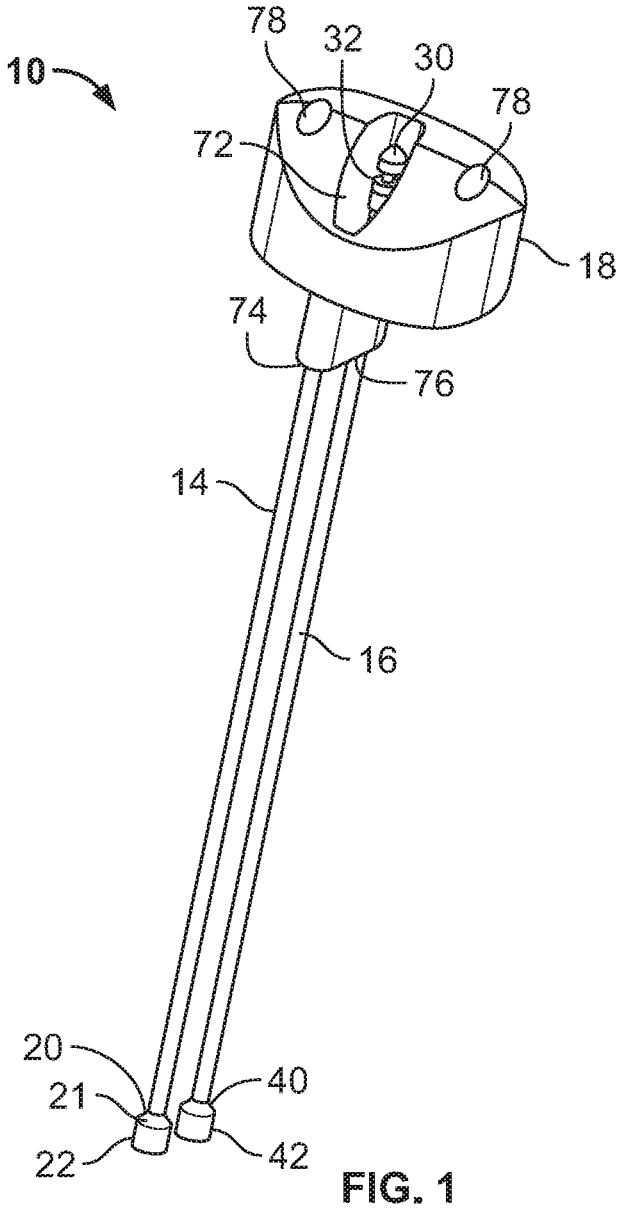
FIG. 1 is a perspective view of one embodiment of the invention in a first state.
Figure 2:
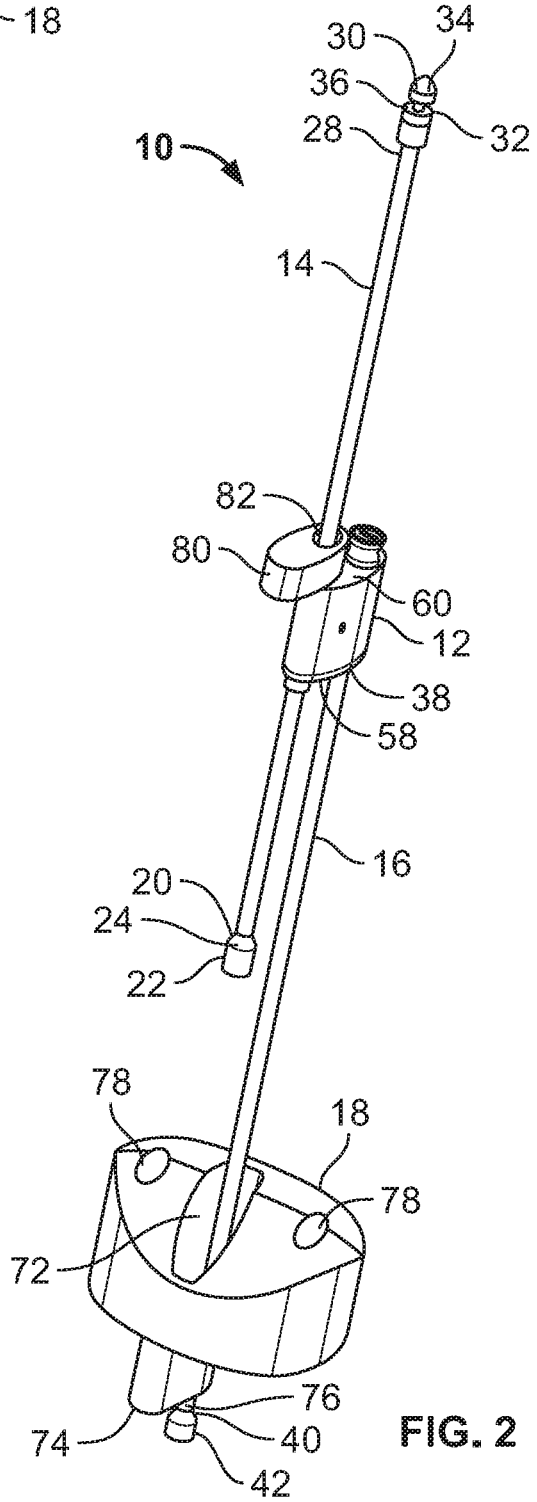
FIG. 2 is a perspective view of one embodiment of the invention is a second state.
Figure 3:
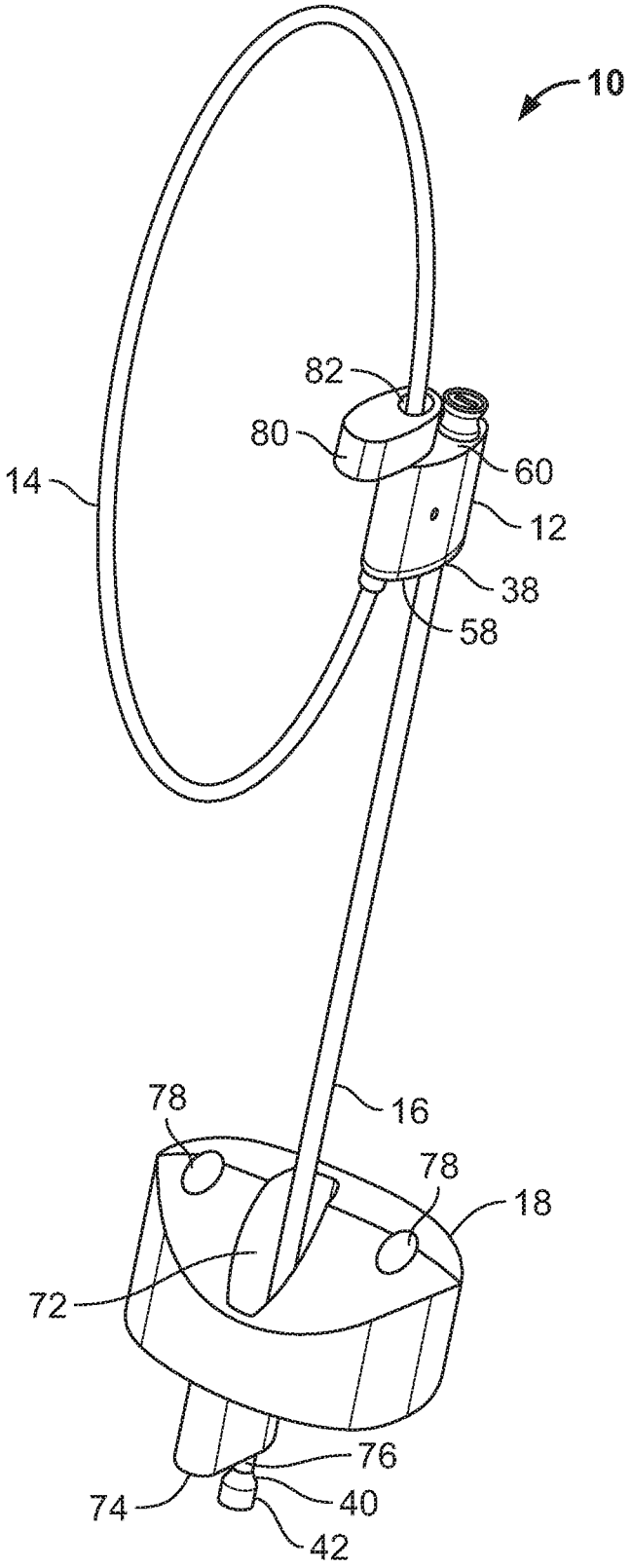
FIG. 3 is a perspective view of one embodiment of the invention in a third state.

The invention, provides a cable lock 10 having a unique lock body 12. In one embodiment, the invention provides a first cable 14 and, in some embodiments, a second cable 16. As seen in FIGS. 1-3, in one embodiment, the invention also provides a base 18.

The first elongate cable 14 has a first end 20 terminating in a knob 22. In one embodiment, the knob 22 has a larger diameter than the first cable 14. The knob 22 has a tapered first end 24 attached to the cable and a tapered second end 26 opposite the first end 24. The first cable 14 also has a second end 28. A chevron or arrowhead 30 is attached to the second end 28 of the first cable on a locking groove 32. The chevron has a tapered terminal end 34 and a substantially transverse flat back end or back side 36 connected to the locking groove 32 and cable 14.

Figure 4:
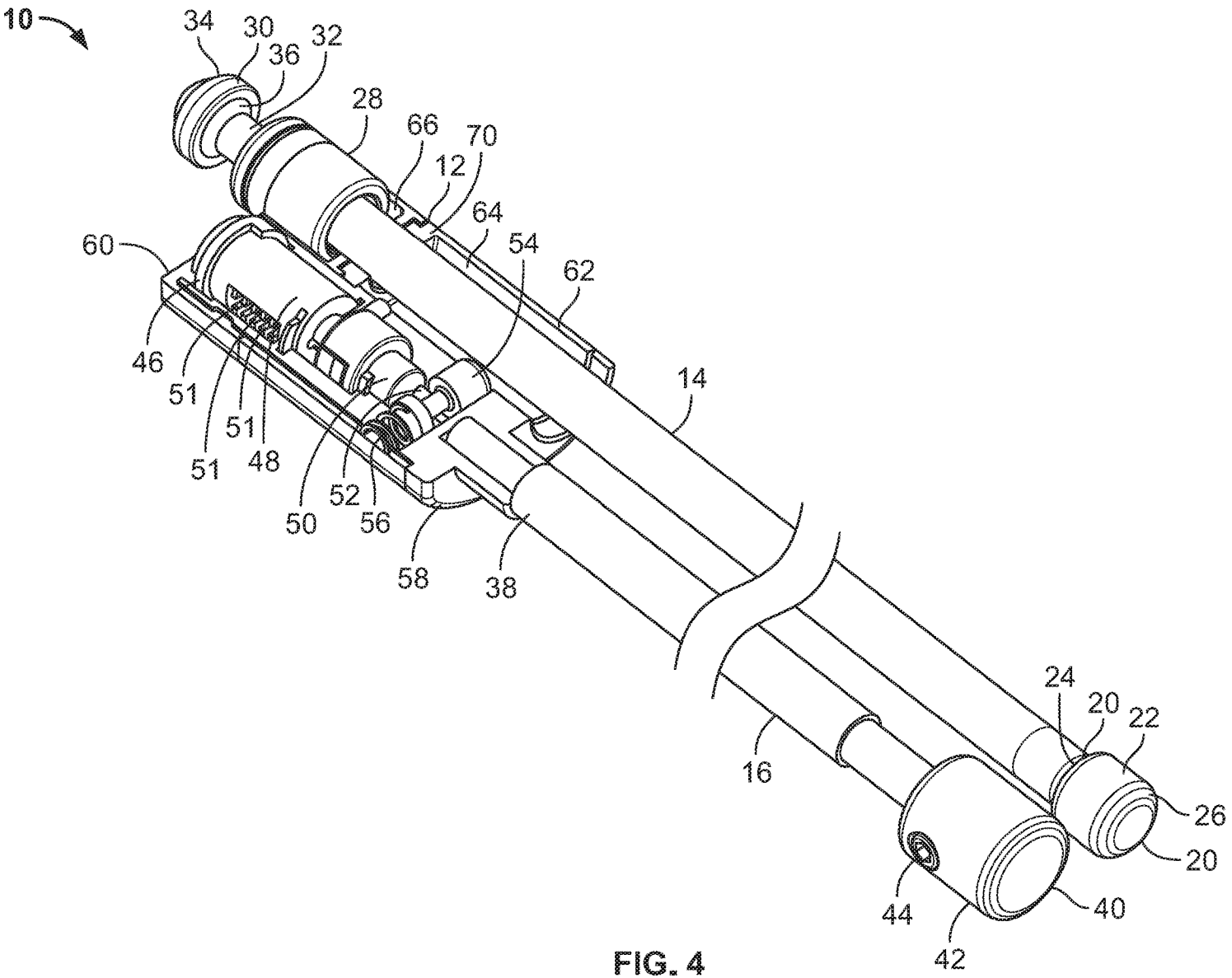
FIG. 4 is a cutaway perspective view of one embodiment of the invention in a first state.

The second elongate cable 16 has a first end 38 fixed to the lock body 12 at the lock body first end 58 and a cable second end 40 terminating in a larger diameter plug 42. As seen in FIG. 4, the plug may be attached to the second end of the cable 16 by a setscrew 44 or swaged onto the cable. Both cables 14 and 16 may have weather resistant sheathes along a majority of their lengths.

The lock body 12 has a first end 58 and opposed second end 60. The lock body 12 comprises a keyway 46 having a bore or barrel 48 extending inwardly from the lock body second end 60, and a plug 50 in the barrel that can rotate in the barrel 48 only with a proper key, not shown, that retracts the appropriate tumblers 51 from grooves in the barrel 48. The faces of the barrel 48 and plug 50 are slightly recessed from the second end 60 of the lock body 12. An exemplary plug 78 and barrel are shown and described in co-pending U.S. patent application Ser. No. 16/439,033 (Publication 2019/0383058) which is incorporated herein by reference.

Rotating the plug 50 moves a bolt 54 out of an adjacent throughbore 62. A bolt cam 52 extends from the end of the plug 50 and interacts with a shoulder on the bolt 54 to retract the bolt 54 against the bias of the spring 56 when the plug is rotated.

A throughbore 62 with an axis 68 parallel to the axis of the keyway 46 and barrel 48 is located in the lock body 12 beside the keyway 46. The throughbore extends from the first end of the lock body 58 to the second end 60 of the lock body 12. A second portion 66 of the throughbore 62 extends inwardly from the second end 60 of the lock body, and a first portion 64 of the throughbore 62 extends inwardly from the first end 58 of the lock body 12. A shoulder 70 separates the first portion 64 and second portion 66 of the throughbore. The diameter of the shoulder 70 is sufficiently large to allow the majority of the cable to pass by but small enough that neither the knob 22 nor the chevron 30 can pass by. As noted above, a bolt 54 is biased partially into the first portion 64 of the throughbore 62 transverse to the axis 68 by a spring 56.

Although the cable lock can reside in many states, three states will be described. The first or open state is best shown in FIGS. 1 and 4. The second end 28 of the first cable 14 is located in the second portion 66 of the throughbore 62 with the chevron 30 extending outwardly from the second end 60 of the lock body 12. Although not visible in FIG. 1, the lock body 12 may be nested in a cradle or cutout 72 of the base 18 in some embodiments. The first cable 14 extends through a first aperture 74 in the base 18 and the second cable 16 extends through a second aperture 76 in the base. The first base aperture 74 has a larger diameter than the knob 22 at the first end 20 of the first cable 14 so the first cable 14 can pass through the base 18. The plug 42 at the second end 40 of the second cable 16 is larger than the second aperture 76 of the base so the base is captured between the second cable plug 42 and the lock body 12. The chevron 30 extends from the second end 60 of the lock body 12 so that it can be grasped by the user and the first cable can be pulled out of the base 18 and from the lock body 12 to an intermediate position or second state as shown in FIG. 2. The base 18 also has shouldered apertures 78 configured for mechanical fasteners to fixedly attach the base to a substrate. These mechanical fasteners may have special features that will not allow them to be unfastened easily, so that the base 18 remains permanently fixed to the substrate so the piece of equipment being secured by the cable lock 10 in the second state cannot be removed from the substrate. As can be seen in FIGS. 1 and 2, in the first and second states, the first 14 and second 16 cables can be in substantially parallel relation and may extend into a substrate.

Figure 5:
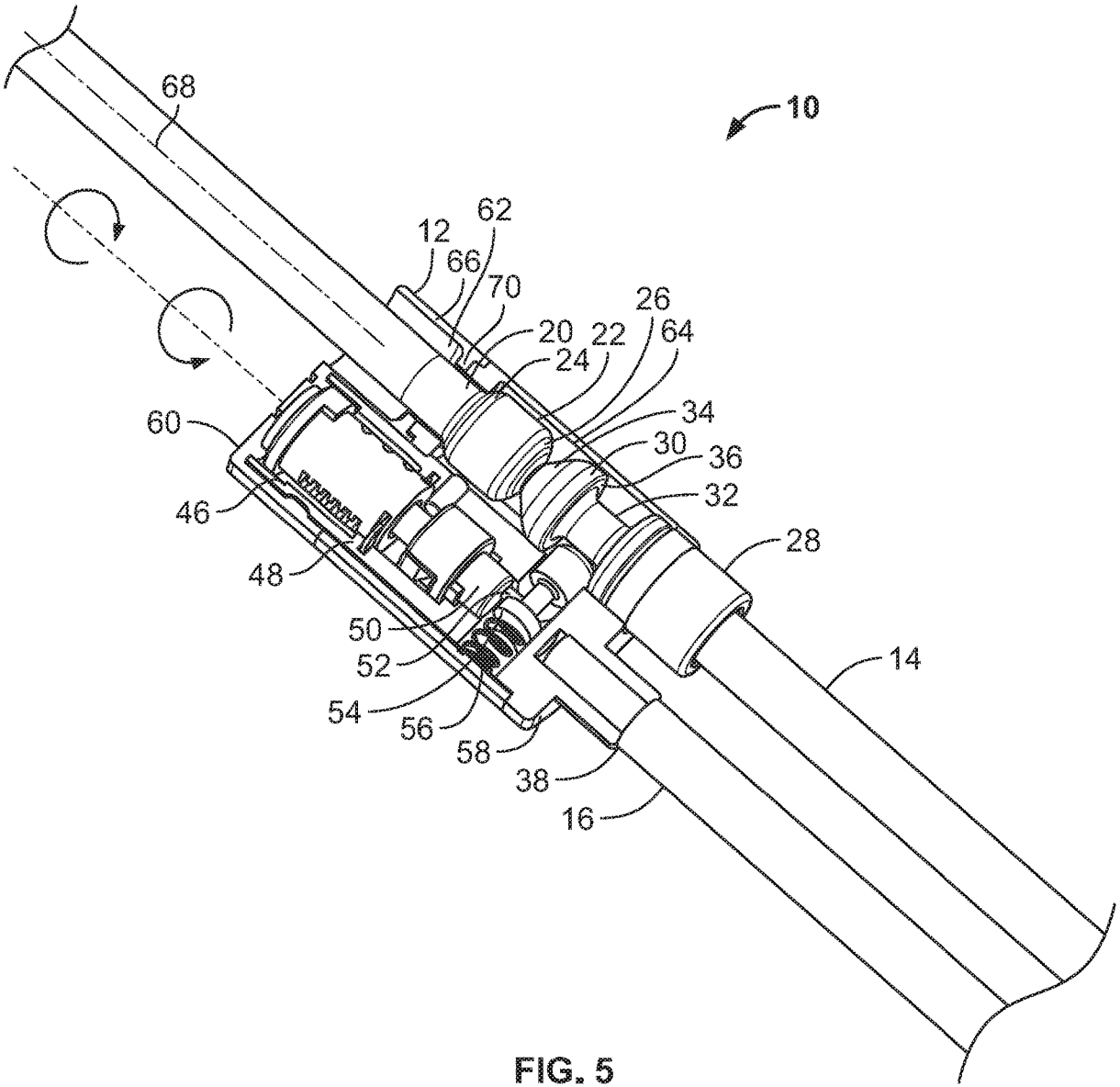
FIG. 5 is a cutaway perspective view of one embodiment of the invention in a third state.

Once the lock body is extracted from the cradle 72 in the base 18 and the second end 28 of the first cable 14 pulled out of the lock body 12, as shown in FIG. 2, the first cable 14 can be further pulled through the throughbore 62 to arrive at the third state, shown in FIGS. 3 and 5. As the knob 22 enters the first portion 64 of the throughbore 62 and slides axially through the first portion 64, the tapered first end 24 contacts the bolt 54 and forces it to move transversely against the bias of the spring 56, allowing the knob 22 to pass by the bolt and contact the shoulder 70. The first cable 14 can be looped around or through the item of equipment desired to be secured and the chevron 30 on the second end 28 of the first cable can be placed into the throughbore 62 at the first end 58 of the lock body. The chevron 30 is then pushed into the first portion 64 of the throughbore 62 to slide axially in the throughbore 62. The tapered end 34 of the chevron 30 also forces the bolt 54 to retract transversely against the bias of the spring 56 to allow the chevron 30 to pass by. Once the chevron 30 passes the bolt 54, the spring 56 urges the bolt back into the throughbore 62 into the locking groove 32, and the transverse flat back face 36 of the chevron cooperates with the bolt 54 to lock the chevron 30 in place.

To unlock the equipment being secured, a proper key is inserted into the keyway 46 to retract the tumblers 51 and rotate the plug 50, which in turn moves the bolt cam 52. The bolt cam cooperates with a shoulder on the bolt 54 to push the bolt against the spring bias and extract the bolt from the throughbore. The chevron 30 and second end 28 of the first cable can then be extracted from the first portion 64 of the throughbore 62. The first end 20 of the first cable 14 can be removed from the throughbore by pushing the knob 22 past the bolt 54. The tapered second end 26 of the knob 22 exerts force on the bolt 54 to force the bolt 54 against the bias of the spring 56 to retract the spring and allow the knob to pass by. Further axial movement of the cable through the throughbore 62 will result in the first cable 14 ending up in the first condition as shown in FIGS. 1 and 4.

A cover 80 can optionally cover the second end 58 of the lock body 12. The cover may have an aperture 82 through which the first cable 14 may pass. The inventive lock body 12 and first cable 14 may also be incorporated in other embodiments of the invention. In one embodiment, the second end 40 of the second cable 16 may be permanently affixed to a base instead the second cable 16 sliding through an aperture 76 in the base. In another embodiment, the lock body 12 may be fixed directly to a base or substrate with no second cable 16. In this embodiment, the lock body 12 would generally be attached to the substrate on its side so the first 58 and second 60 ends of the lock body are clear, and the first cable 14 can slide through the throughbore 62.

Although the above described cable lock has been described, modifications to the structure and associated uses are contemplated by this disclosure. In some embodiments, a pair of cables is contemplated as shown in FIGS. 1-3. However, as noted above, it can be appreciated that the lock body 12 can be used with a single first cable 14 if only a lockable loop is needed. In addition, other means for capturing the chevron 30 other than a transversely moving bolt 54 are contemplated. In addition, other means for having a base with apertures that allow two cable to pass through so they are generally hidden from view when not in use, but only have one cable captured by the base are considered in the disclosure.

Various embodiments disclosed herein are to be taken in the illustrative and explanatory sense, and should in no way be construed as limiting of the present disclosure. While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof

I claim:

1. A cable lock comprising:

an elongate cable with a first end having a knob, and a second end terminating in a chevron, with the chevron having a tapered end and a flat transverse back face;

a lock body having a first end and a second end and having a keyway and a cylindrical throughbore parallel to the keyway, the throughbore extending from the first end to the second end and having a first portion and a second portion separated by a shoulder;

the keyway having a plug that selectively rotates with a proper key;

a bolt transverse to the throughbore and retractably biased into the throughbore first portion and selectively retractable against the bias out of the throughbore first portion by rotation of the plug;

wherein in a first state, the cable second end is accommodated in the throughbore second portion and the cable extends through the throughbore first portion and out of the lock body first end; and wherein in a second state the cable extends through the throughbore second portion, out of the lock body second end, and the cable first end and the cable second end are captured in the first portion of the throughbore between the bolt and the shoulder with the bolt cooperating with the flat transverse back face of the chevron.

2. The cable lock of claim 1, with the knob having a tapered first end attached to the cable and a tapered second end opposite the first end, and wherein when transitioning from the first state to the second state, the bolt is pushed out of the throughbore by the knob tapered first end during axial movement of the knob in the first portion of the throughbore in a first direction.

3. The cable lock of claim 2, wherein when transitioning from the first state to the second state, the bolt is also pushed out of the throughbore by the tapered end of the chevron during axial movement of the chevron in a first direction.

4. The cable lock of claim 2, wherein when transitioning from the second state to the first state, the chevron is initially released by the bolt being retracted by rotating the plug with the proper key, and the knob is released by the bolt being pushed out of the throughbore by the knob tapered second end during axial movement of the knob in the first portion of the throughbore in a second direction.

5. The cable lock of claim 1, also having a second cable extending from the lock body first end.

6. The cable lock of claim 5, wherein the second cable has a first end connected to the lock body first end and a second end having a plug, with the plug having a larger diameter than the second cable.

7. The cable lock of claim 6, also comprising a base, with the base having first and second apertures configured to allow the first and second cables respectively to pass through.

8. The cable lock of claim 7, wherein the diameter of the second aperture in the base is smaller than the diameter of the second cable plug.

9. The cable lock of claim 8, wherein the diameter of the first aperture in the base is larger than the first cable knob.

10. The cable lock of claim 8, wherein the base also has a cradle with the cradle adapted to accommodate the lock body when the first and second cables extend through their respective apertures.

11. The cable lock of claim 9, wherein the base is captured between first end of the lock body and the second cable plug.

12. The cable lock of claim 6, also having a lock body cover, the cover having an aperture through which the first cable passes.

13. A twin cable lock for securing equipment comprising:

a lock body having a first end and a second end and having a keyway and a cylindrical throughbore extending through the lock body from the first end to the second end with an axis parallel to the keyway, the throughbore having a first portion and a second portion separated by a shoulder;

a first elongate cable extending through the throughbore with a first end having a knob, and a second end terminating in a chevron, with the chevron having a tapered end and a flat transverse back face;

a second cable having a first end and depending from and attached to the lock body first end at the second cable first end;

the lock body also having a bolt that is retractably biased into the first portion of the throughbore transverse to the throughbore axis;

the keyway having a plug that is rotatable with the proper key to retract the bolt from the throughbore against the bias;

wherein the chevron can pass by the bolt as the chevron moves axially in the throughbore in a first direction by the chevron tapered end urging the bolt out of the throughbore against the bias, but the chevron cannot pass by the bolt as the chevron moves axially in the throughbore in a second direction without the bolt being retracted by the plug.

14. The twin cable lock of claim 13, also comprising a base having first and second apertures and a cradle adapted to accommodate the lock body with the first cable passing through the first aperture and the second cable passing through the second aperture and the cradle accommodating the lock body.

15. The twin cable lock of claim 14, wherein the knob at the first end of the first cable has a diameter that is adapted to allow the knob to move axially in the throughbore, with the knob diameter also less than the diameter of the first aperture in the base.

16. The twin cable lock of claim 15, wherein the knob at the first end of the first cable has a tapered first end attached to the cable and a tapered second end opposite the first end, with both tapers adapted to contact and retract the bolt against the bias as the knob moves axially in the throughbore past the bolt in a first or second direction.

17. The twin cable lock of claim 15, wherein the second cable has a second end and a plug at the second end with the plug having a diameter greater than the diameter of the base second aperture, and in a first state both cables depend from lock body and the base in substantially parallel relation, and the lock body resides in the cradle.

18. The twin cable lock of claim 13, wherein a spring biases the bolt into the throughbore.

19. The twin cable lock of claim 15, wherein in a second state, first cable extends through the throughbore second portion and the knob is located in the throughbore first portion and knob first tapered end contacts the throughbore shoulder and the chevron transverse flat backside contacts the bolt to capture the knob and chevron in the first portion of the throughbore.

* * * * *